US005947805A

United States Patent [19]

Van Osenbruggen

[11] Patent Number: 5,947,805

[45] Date of Patent: Sep. 7, 1999

[54] ACCESSORY FOR AN ANGLE GRINDER

[75] Inventor: Anthony Alfred Van Osenbruggen, Auckland, New Zealand

[73] Assignee: Norton Company, Worcester, Mass.

[21] Appl. No.: 08/894,235

[22] PCT Filed: May 3, 1995

[86] PCT No.: PCT/NZ95/00035

§ 371 Date: Oct. 21, 1996

§ 102(e) Date: Oct. 21, 1996

[87] PCT Pub. No.: WO95/29788

PCT Pub. Date: Nov. 9, 1995

[30] Foreign Application Priority Data

May 3, 1994 [NZ] New Zealand ..... 260449
Mar. 2, 1995 [NZ] New Zealand ..... 270604

[51] Int. Cl.[6] ..... B24B 23/00

[52] U.S. Cl. ..... 451/358; 451/541; 83/835; 83/698.41

[58] Field of Search ..... 451/358, 359, 451/541, 360, 363, 342; 83/835, 839, 854, 698.41

[56] References Cited

U.S. PATENT DOCUMENTS

| | | | |
|---|---|---|---|
| 877,146 | 1/1908 | Ward | 83/835 |
| 1,736,560 | 11/1929 | Walker | 83/835 |
| 1,861,218 | 5/1932 | Huther | 83/835 |
| 1,871,674 | 8/1932 | Ellithorpe | 451/353 |
| 1,951,105 | 3/1934 | Myers | 451/353 |
| 3,375,617 | 4/1968 | Kaufman et al. | 451/359 |
| 4,033,077 | 7/1977 | Chester et al. | 451/359 |
| 4,288,187 | 9/1981 | Wanner et al. | 451/359 |
| 4,462,381 | 7/1984 | Fushiya et al. | 451/359 |
| 5,317,945 | 6/1994 | Waggerman | 83/835 |
| 5,613,538 | 3/1997 | Brisson | 83/698.41 |

*Primary Examiner*—M. Rachuba
*Attorney, Agent, or Firm*—David Bennett

[57] ABSTRACT

Accessories for an angle grinder include a rotary disc cutting tool and a rest for supporting the grinder on a surface to be shaped. The rest may be a non-rotating nose beneath the grinder or a rubbing contact mounted on a flat tool, or it may be part of a convex tool. Tilting the grinder about the rest give effective control of the tool. Steeper tilts cause the cutting surface to bite more deeply into the work surface. The grinder is stroked toward the user with the cutting zone trailing. Most disks are perforated. Work to be shaped can be seen through the spinning disk during use.

9 Claims, 8 Drawing Sheets

Figure 1:
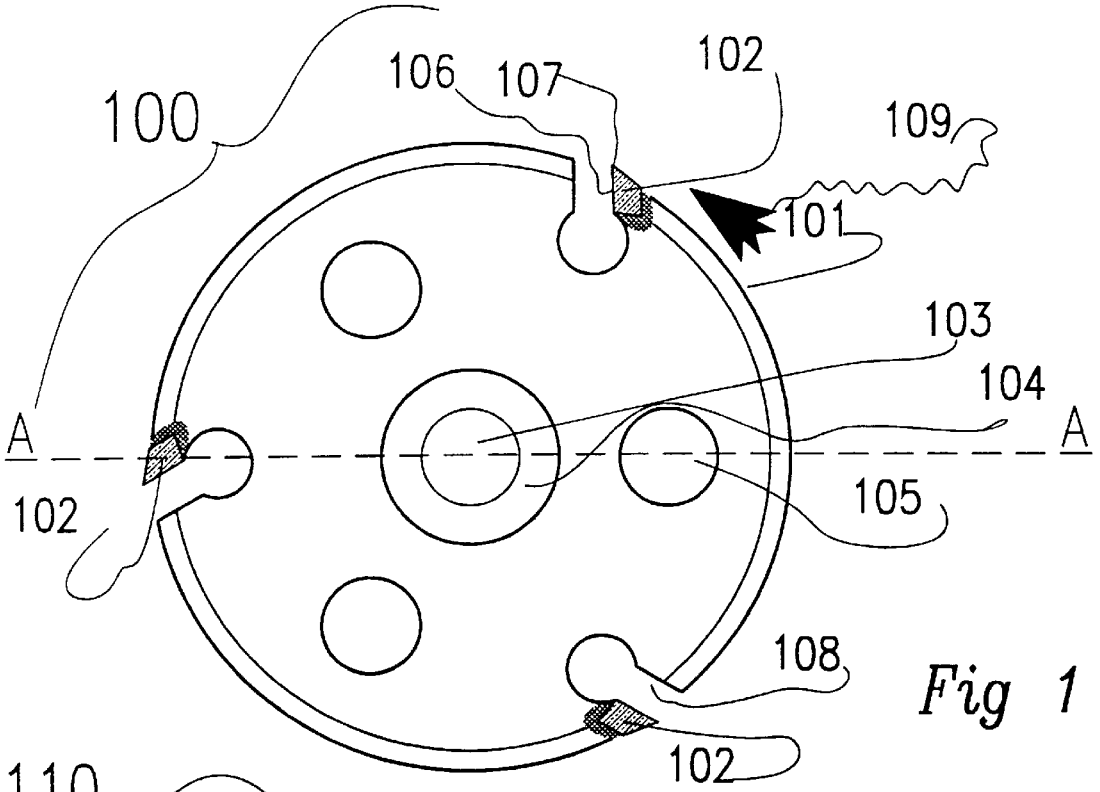

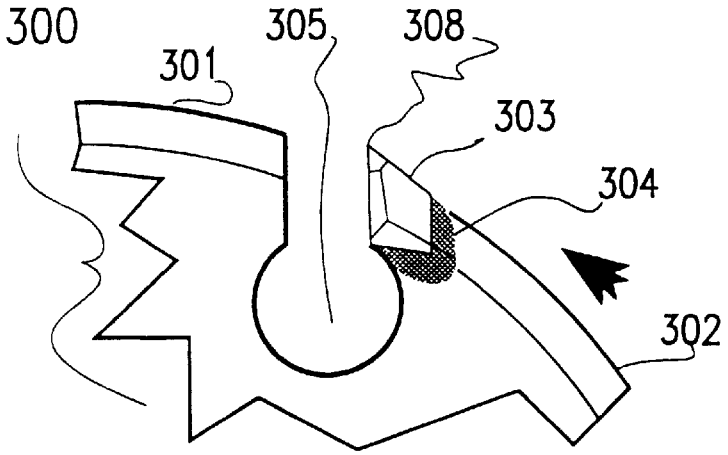
Fig 3
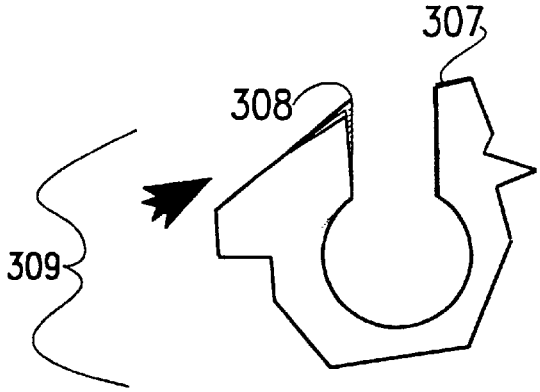
Fig 8
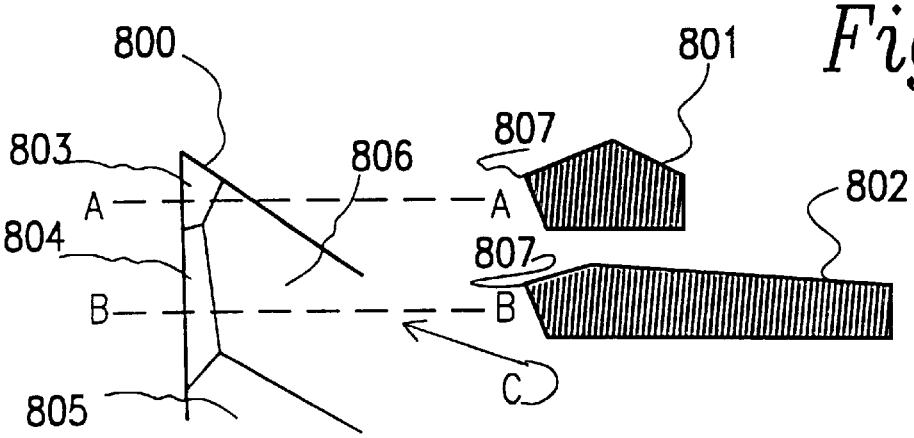

ACCESSORY FOR AN ANGLE GRINDER

TECHNICAL FIELD OF THE INVENTION

This invention relates to the field of disc-shaped cutting, rotating tools of the type having manufactured edges or teeth, which tools may be used for shaping and forming materials, and in particular this invention relates to accessories for angle grinders, such as cutting blades which are adapted for use with a hand-held angle grinder.

BACKGROUND

A number of applications in the construction or repair of solid articles involve the selective removal of material from a bulk in order to produce a desired conformation or shape. For example a builder may remove some wood from a beam in order to produce a neat fit—more likely if the house being built is non-rectangular; a foundry removes surplus metal from sprues or joints between mould parts when producing a casting; a wood carver selectively removes wood in order to produce a carving; a panel beater frequently removes surplus plastic filler which was placed within a defect in an automotive panel to build it up, so that the outline conforms with the original outline of the panel; or a boat builder may have to remove kilograms of material, such as lead-filled fibreglass when shaping or repairing a hull.

The act of selective removal, particularly if carried out by abrasive means, involves the expenditure of considerable effort and abrasive materials. The work can be quite slow. There is also a number of problems and health risks associated with the consequent fine dust, having potentially toxic, carcinogenic, or explosive properties. Moreover, dust containing glass fibre is particularly dangerous to the lungs.

It is an aim of the present invention to provide an improved rotatable cutter for selective removal of solid material, or to at least provide the public with a useful choice.

STATEMENT OF THE INVENTION

In a first aspect the invention comprises an accessory for a grinder including a rotatable tool having a shape substantially that of a disk, having an axis of rotation and capable of being mounted on an arbor of an angle grinder, characterised in that the rotatable tool is provided with a working zone extending inwardly from the perimeter of the tool; and rest means extending substantially inwardly from the working zone of the tool, which rest means is displaced from the working zone along the line of the axis of rotation.

In a related aspect the invention comprises an accessory for a grinder characterised in that the rest means is concentric with and supported on the rotatable tool.

In a related aspect the invention comprises an accessory for a grinder characterised in that the rest means comprises a portion of a convex working surface of the rotatable tool and the rest means includes at least one rubbing surface located between the active zone and the axis of rotation.

In a related aspect the invention comprises an accessory for a grinder characterised in that the rest means comprises a fixed rubbing surface or nose supported on the angle grinder and displaced so as to be supported beyond the rotatable tool. (By "beyond" we mean beyond the end of the arbor, or below the tool as it is normally held).

In a related aspect the invention comprises an accessory for a grinder characterised in that the working zone comprises at least one area within a permitted surface of the rotatable tool, said permitted surface extending inwardly over the working surface from the perimeter over substantially a first third of the radius.

In a related aspect the invention comprises an accessory for a grinder characterised in that the working zone of the rotatable tool is provided with at least one cutting tooth; each cutting tooth has at least one cutting edge lying in a plane substantially coplanar with the radially adjacent surface of the tool; and each cutting tooth projects from the radially adjacent surface of the tool by a height of up to 3 per cent of the diameter, so that the depth of cut of each tooth is limited.

In a related aspect the invention comprises an accessory for a grinder characterised in that each cutting tooth is additionally provided with a tooth rubbing surface or gauge surface; the rubbing surface projecting outwardly at least as far as the cutting zone of the tooth, thereby limiting the depth of cut of each tooth.

In a related aspect the invention comprises an accessory for a grinder characterised in that the working zone of the rotatable tool is provided with at least one hardened surface bearing a series of stubby projections, the hardened surface comprising at least one sector on at least one side of the rotatable tool, and a rubbing surface is provided adjoining the sector and extending in the plane of the surface of the rotatable tool from the or each sector. (By "stubby projections" we refer to a surface bearing tetrahedra or such shapes, preferably having distinct corners though preferably not having knife edges).

In a related aspect the invention comprises an accessory for a grinder characterised in that the cutting zone is an abrasive surface comprising a matrix including a hard granular material coated onto at least a portion of one side and/or the edge of the rotatable cutting tool.

In a related aspect the invention comprises an accessory for a grinder characterised in that at least one viewing aperture is provided through the disk of the rotatable tool and in which at least one viewing aperture may, when the tool is rotating, also serve to cause air movement.

In a related aspect the invention comprises an accessory for a grinder characterised in that a central recessed mounting aperture is provided with gripping means or clutch means capable of disengagement substantially as long as a torque applied between the rotatable spindle and the cutting tool exceeds a predetermined amount.

In a related aspect the invention comprises an accessory for a grinder characterised in that the central recessed mounting aperture is provided with resilient mounting means capable of reducing vibration.

In a further aspect the invention comprises a hand-held grinder system for use in shaping a surface, including a rotatable cutting tool mounted on a rotatable spindle, an active contact zone on said rotatable cutting tool, which active contact zone is capable of removing material from the surface, and rest means (a rest zone), which rest zone, in use, permits control of the shaping action of the grinder system if the grinder system is first rested against the work by means of the rest zone and then the grinder system is tilted more towards the active contact zone in order to cause or increase engagement of the active contact zone with the surface.

In a related aspect the invention comprises a hand-held grinder system as described previously, wherein the separate rubbing surface is provided with rotational bearing means so that in use the separate rubbing surface may rotate independently of the rotatable cutting tool.

In a related aspect the invention comprises a rotatable cutting tool as described previously, in which the teeth are created by a shaping treatment followed by a hardening process applied to at least part of the material of the rotatable cutting tool.

In a related aspect the invention comprises a rotatable cutting tool as described previously, in which the teeth are manufactured from a separate, hard material and then fixed to the rotatable cutting tool.

In a related aspect the invention comprises a rotatable cutting tool as described previously, wherein each tooth is slidably mounted within a substantially radially oriented restraining mount so that during rotation the tooth can be held against the work surface by centrifugal forces and can move further out as the cutting edge becomes worn.

In a related aspect the invention comprises a rotatable cutting tool for a hand-held grinder system as described previously, in which an abrasive face is provided by affixing a sectored, ribbed or knurled surface (hence bearing stubby projections) of a hard material onto sectors on at least one side of the shaped cutting tool and a rubbing surface is provided upon intervening sectors.

In a related aspect the invention comprises a rotatable cutting tool as described previously, in which there are between three and twelve sectors of a hard material. In a related aspect the invention comprises a rotatable cutting tool suitable for a hand-held grinder system as described previously, for which rotatable cutting tool an abrasive face is provided by affixing an abrasive matrix including a hard granular material onto at least portions of one side and the edge of the rotatable cutting tool.

In a related aspect the invention comprises a rotatable cutting tool as described previously, in which the abrasive face is provided on one side of the rotatable cutting tool.

In a related aspect the invention comprises a rotatable cutting tool as described previously, in which each tooth is mounted on an edge of an aperture or throat into which aperture or throat any swarf, shavings or cuttings removed from the work surface may be fed.

In a related aspect the invention comprises a rotatable cutting tool as described previously, in which each throat is provided with an inwardly projecting member capable in use of breaking up swarf, shavings or cuttings contained within the aperture or throat.

In a related aspect the invention comprises a rotatable cutting tool suitable for a hand-held grinder system as described previously, in which at least one viewing aperture is provided through the tool and in which at least one viewing aperture may when the tool is rotating also serve as to cause air movement.

In a related aspect the invention comprises a rotatable cutting tool as described previously, in which at least one edge of the or each viewing aperture is shaped and treated in order to serve as a cutting edge.

In a related aspect the invention comprises a rotatable cutting tool suitable for a hand-held grinder system as described previously, wherein a central mounting aperture is provided, the aperture being adapted for attachment to the rotatable spindle.

In a related aspect the invention comprises a rotatable cutting tool as described previously, wherein the central recessed mounting aperture is provided with clutch means capable of disengagement while a torque applied between the rotatable spindle and the cutting tool exceeds a predetermined amount.

In a related aspect the invention comprises a rotatable cutting tool as described previously, wherein the central recessed mounting aperture is provided with resilient mounting means capable of reducing vibration caused by eccentricity.

In a related aspect the invention comprises a accessory for an angle grinder, comprising a rotatable cutting tool comprising a disk bearing a small number of sharpened teeth having cutting edges at or close to its periphery, and a small number of rubbing surfaces by the teeth, wherein the cutting edges protrude beyond the rubbing surfaces by less than 2 to 3 mm for a 120 mm disk diameter.

In a still further aspect this invention comprises a rotatable cutting tool comprising a disk bearing a small number of sharpened teeth having cutting edges at or close to its periphery, and a small number of rubbing surfaces by the teeth, wherein the cutting edges protrude beyond the rubbing surfaces by less than 2 mm for a 120 mm disk diameter. Preferably the teeth are provided at three places about the disk. Optionally each tooth may be provided with a throat and optionally this throat may extend to the perimeter of the disk. Optionally the throat may be provided with means to entrap any swarf. Optionally the holes may be shaped in order to be capable of moving air when in use, and thereby control any swarf.

Preferably the rubbing surfaces comprise the material of the disk itself, at about the same distance from the centre as the actual teeth. Optionally the rubbing surfaces may comprise adjacent teeth, or inserts of a hard material. Preferably the means for attachment of the disk comprises a shaped depression, shaped to match the profile of an arbor and nut. Preferably the nut includes means to impose a grip on this disk using static friction, and preferably the static friction is overcome at a torque less than that which can damage a means for driving the rotary shaft. Preferably the disk is adapted for use with an ordinary angle grinder. Optionally it may be adapted for use with other rotatable powered machines. Optionally the angle grinder may be fitted with a guard, in order to control swarf.

In a still further aspect the invention comprises a method for shaping material, comprising the steps of (a) causing a disk according to the above description to be affixed to an angle grinder or the like, (b) applying power to the angle grinder motor, (c) holding the disk against the work while tilted at a low angle to it (so that the teeth are not engaged) and raising the tilt to a higher angle so that the teeth are engaged to a suitable depth, and (d) drawing the cutting disk towards the user meanwhile having the opportunity to view the work through apertures in the rotating disk.

In a still further aspect of the present invention there is provided a cutter for shaving away or shaping material comprising a rotatable disk having a working and non-working surface, and having at least one cutting site or tooth upon the working surface. Preferably the number of cutting teeth is between one and twenty four. More preferably there are three cutting teeth provided on the cutter.

Preferably the disk is adapted for mounting upon the spindle or arbor of an angle grinder tool and for this purpose the disk is provided with an optionally threaded central mounting aperture. Optionally the border of the central aperture is depressed towards the inner surface of the disk. Preferably the disk is made of mild steel although alternatively it may be made from a hardenable metal or alloy or from a plastics material. Optionally the disk may be made by other processes, including pressure die-casting. Preferably a mild steel disk is 2 to 6 mm thick. Optionally the disk may be flat and in this case there may be two functional outer surfaces having cutting teeth, although only one can be used at one time. Preferably the disk is deformed into a conical or curved profile and preferably the outer cutting surface is a convex surface. Preferably the teeth are formed from hard material each provided with a cutting edge having a positive angle with respect to the direction of rotation. Optionally each tooth may be formed from an insert of a hard material. More preferably the hard material is tungsten carbide. Alternatively the hardened edge may be formed from the bulk material of the cutter, optionally by chemical or heat treatment which may be localised in application.

Alternatively the cutter may be a removable insert, capable of feeding itself towards the periphery of the cutter during use under the influence of centripetal forces. Optionally there is a spring device to cause the cutter to move towards the centre of the disk when the disk is slowed, as by overloading. Preferably each tooth is also provided with adjacent gauging or tooth rubbing means. The gauging means may be a portion of the tooth provided with an edge having a negative cutting angle, or may be an adjacent raised portion on the outer surface of the cutter. Optionally the actual angles may be varied according to the type of material on which the cutter is to be used. Alternatively the gauging means may be a raised portion of the perimeter of an aperture through the cutter.

DRAWINGS

The following is a description of a preferred form of the invention, given by way of example only, with reference to the accompanying drawings in which:

FIG. 1: is a convex-surface view of a cutter according to the present invention.

Figure 2:
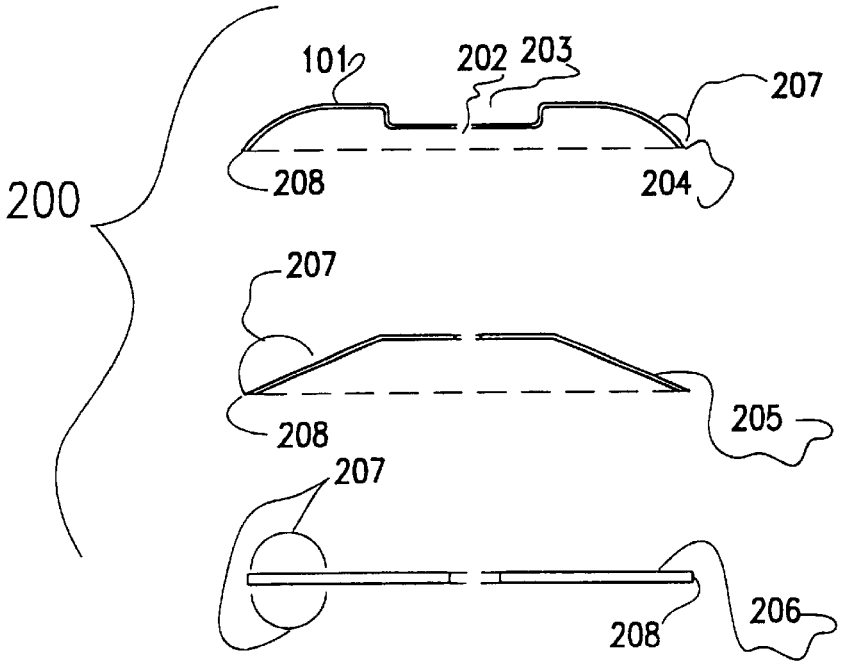

FIG. 2: shows three cutter profiles, according to further embodiments of the invention.

FIG. 3: is a side view of one tooth of a cutter, from the outer and inner sides, according to the invention.

Figure 4:
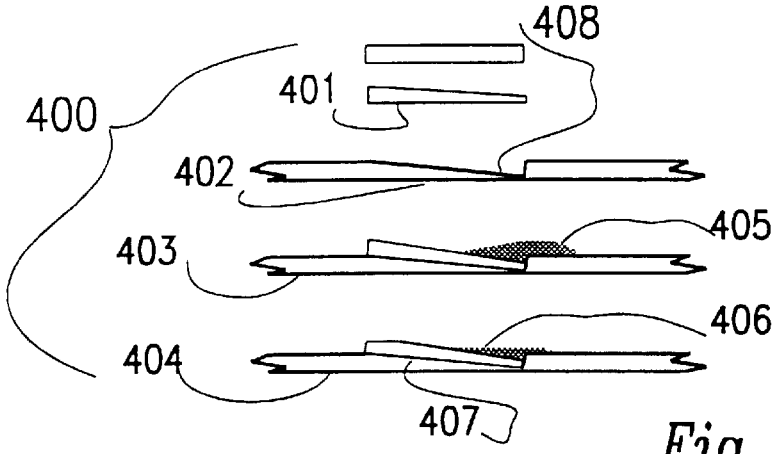

FIG. 4: shows three steps in inserting a tooth of a cutter, according to the invention.

Figure 5:
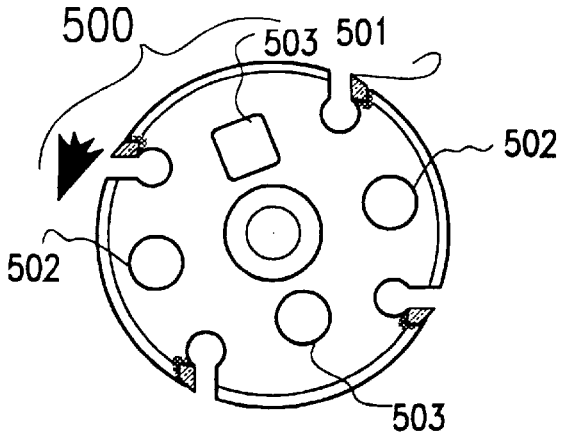

FIG. 5: is a convex-surface view of a four-tooth cutter according to a further embodiment of the invention.

Figure 6:
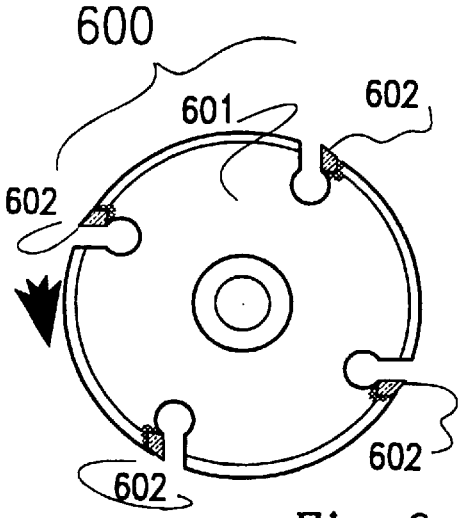

FIG. 6: shows a cutter in section, (without viewing holes).

Figure 7:
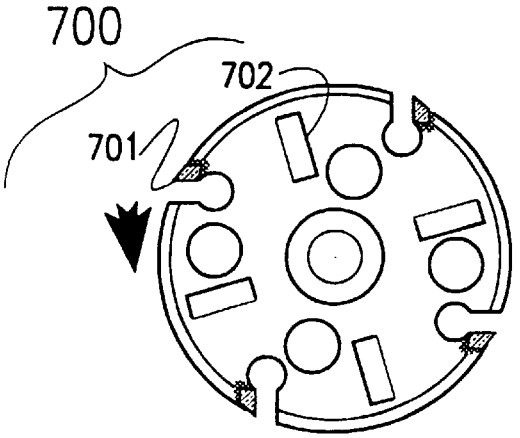

FIG. 7: is a convex-surface view of a cutter including four raised guide-plates and four teeth, according to a further embodiment of the invention.

FIG. 8: shows details of one tungsten carbide tooth in surface view and in section, according to the invention.

Figure 9:
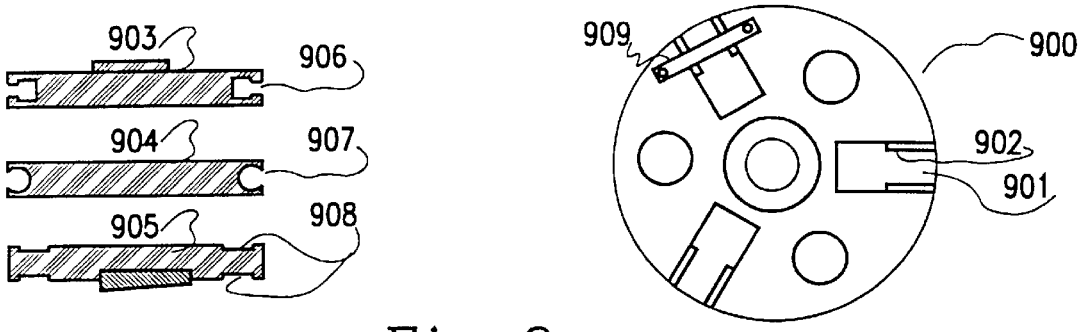

FIG. 9: is a convex-surface view of a cutter incorporating replaceable sliding teeth, according to a further embodiment of the invention.

Figure 10:
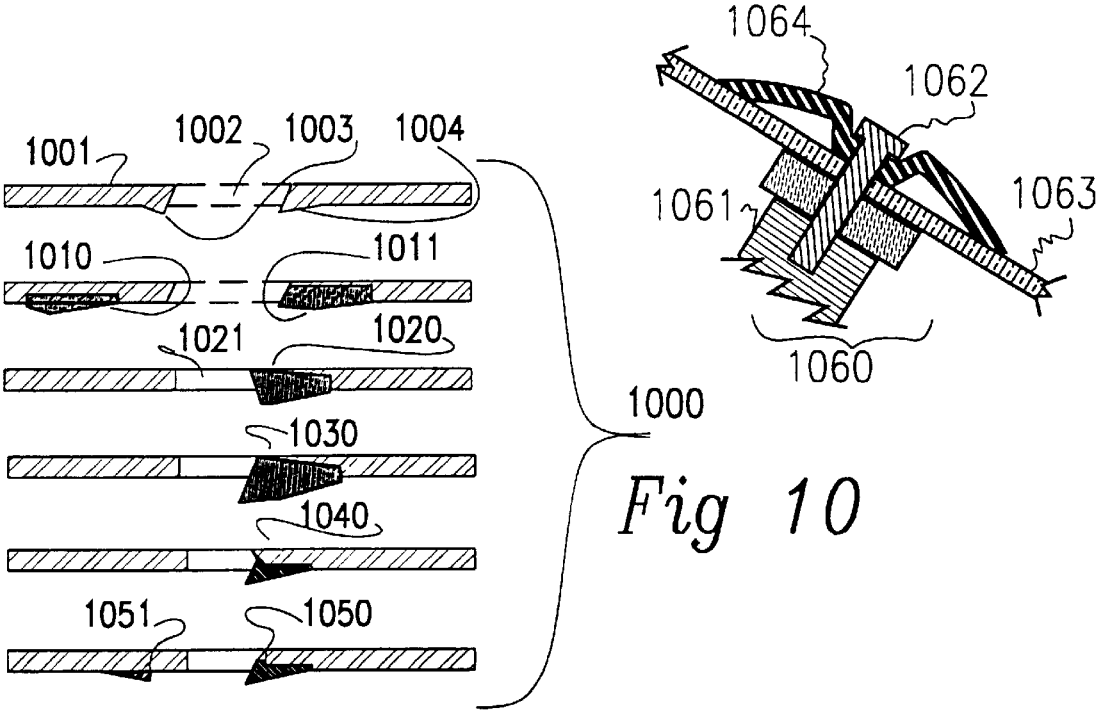

FIG. 10: shows some versions of an aperture of a cutter in section, sharpened according to further embodiments of the invention.

Figure 11:
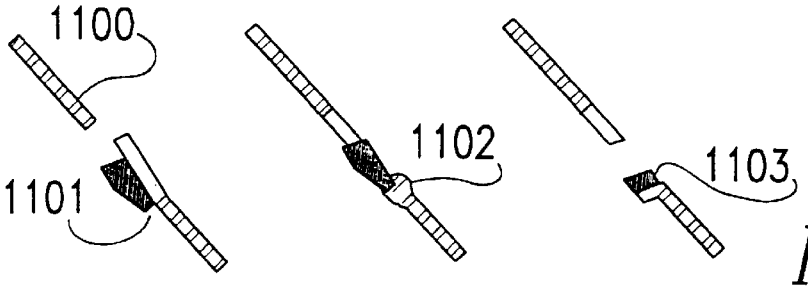

FIG. 11: shows some arrangements for mounting cutter inserts on a blade.

Figure 12:
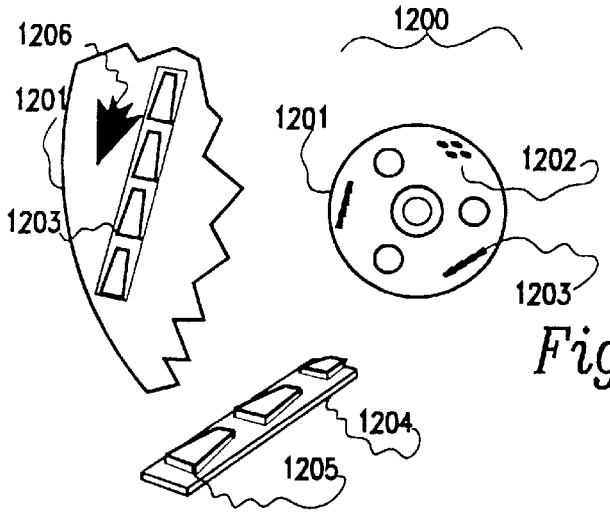

FIG. 12: shows a cutter blade according to the invention adapted for use on masonry or the like.

Figure 13:
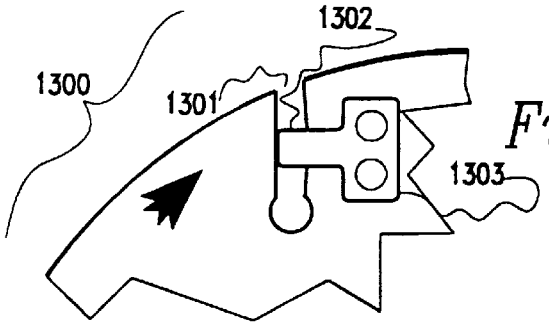

FIG. 13: shows a cutter blade having chip guards.

Figure 14:
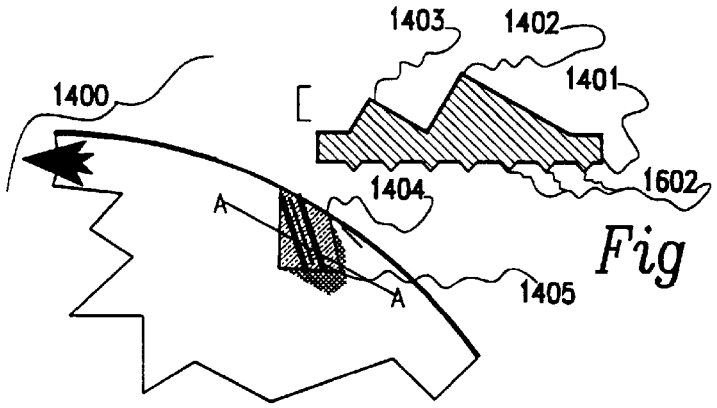

FIG. 14: shows a cutter blade having teeth which provide a broaching action.

Figure 15:
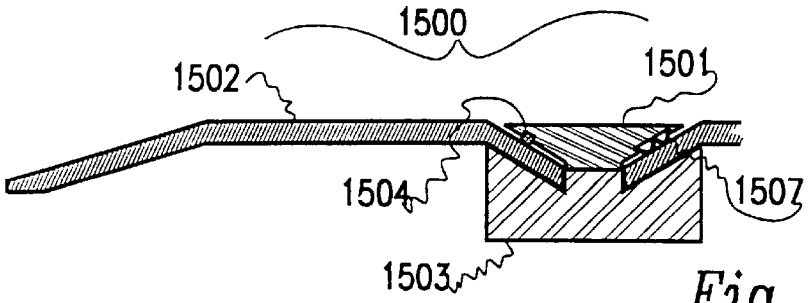

FIG. 15: shows some arrangements for mounting a cutter blade on an angle grinder.

Figure 16:
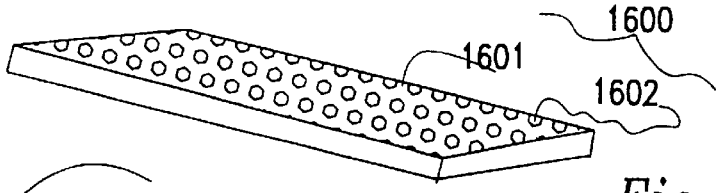

FIG. 16: shows further arrangements for mounting cutter inserts on or within a blade.

Figure 17:
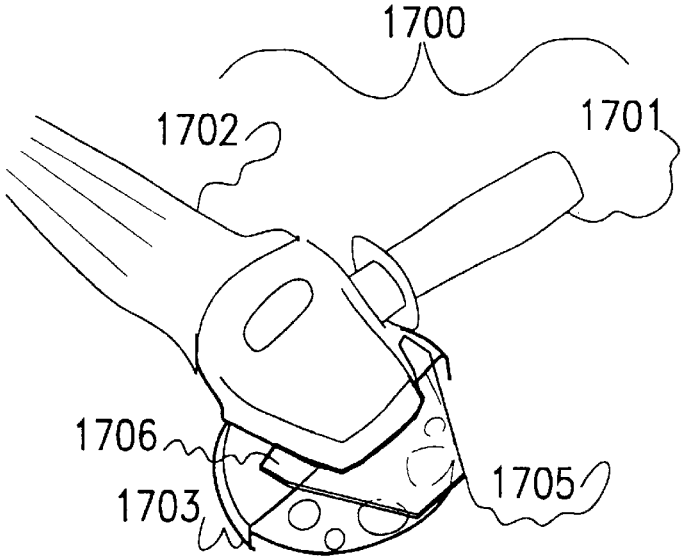

FIG. 17: shows a type of guard suitable for use on an angle grinder along with cutter blades according to the invention.

Figure 18:
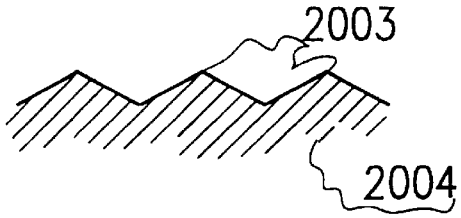
Figure 18:
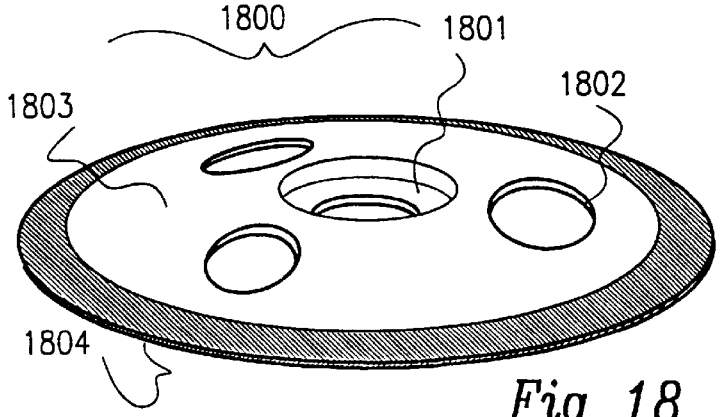

FIG. 18: shows a flat wheel, with an abrasive edge, and a dome-shaped central profile (optionally a nut) according to the invention.

Figure 19:
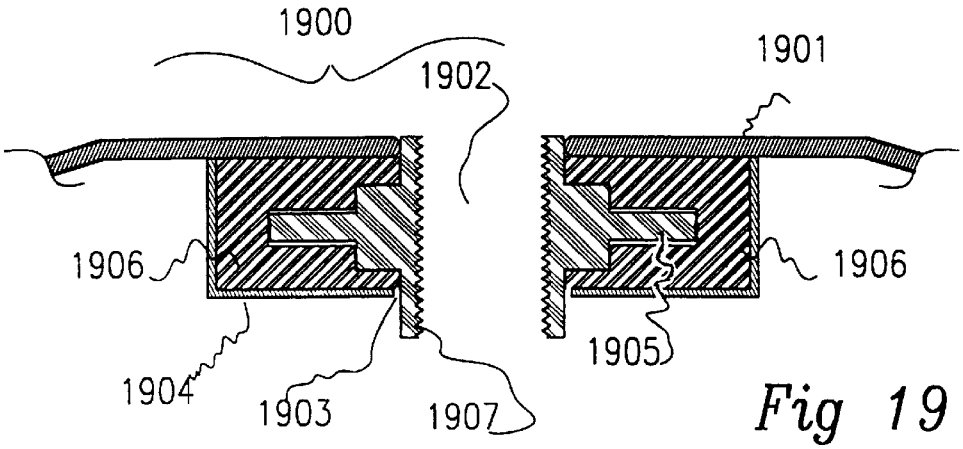

FIG. 19: shows a type of resilient central mount for a wheel according to the invention.

Figure 20:
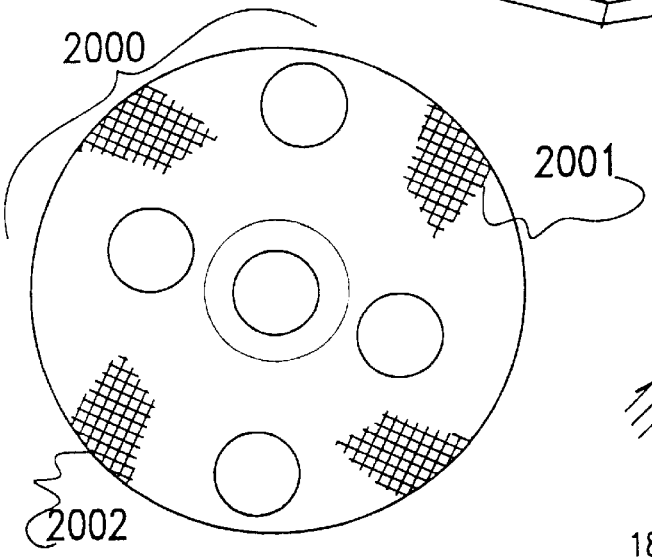

FIG. 20: shows a further type of relatively abrasive wheel, having a hard, ridged surface.

Figure 21:
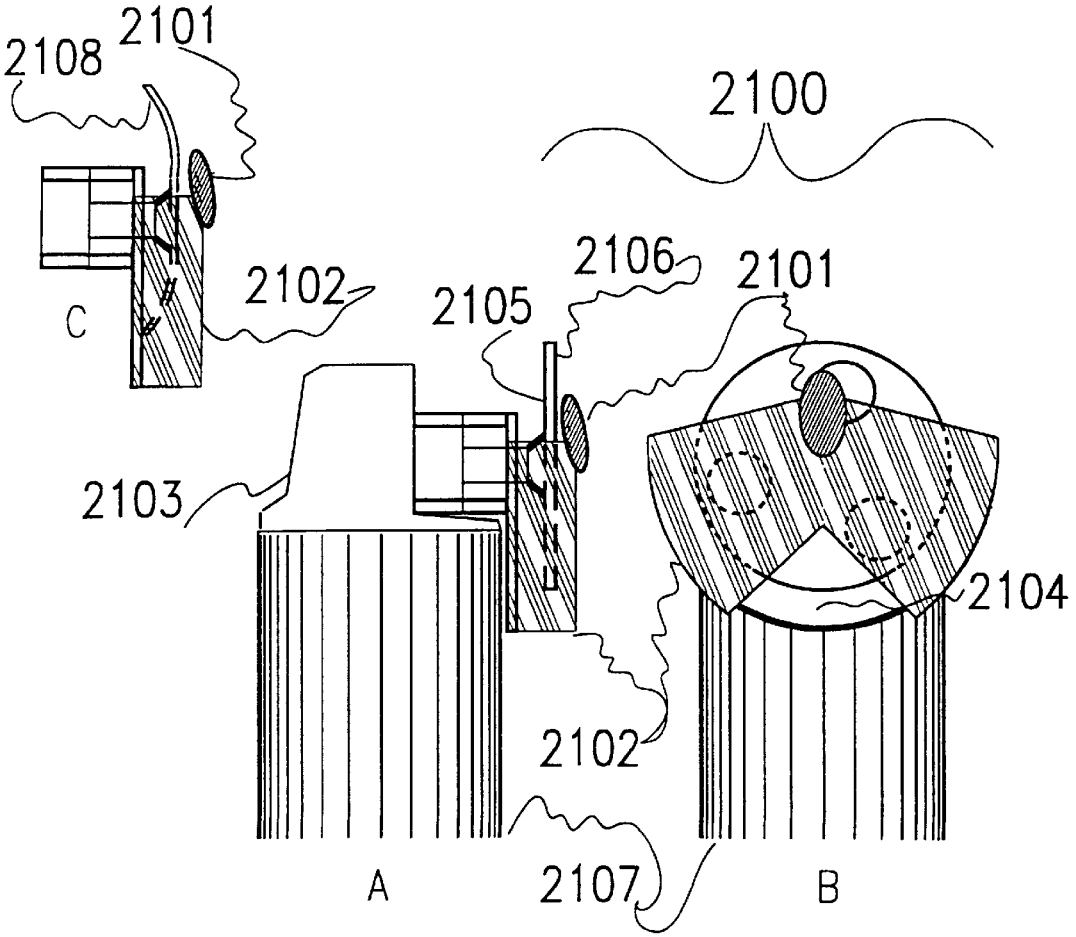

FIG. 21: shows a type of guard for a grinder system, including a central mound or protrusion capable of being used as a rest point, hence better control of the tool is possible.

Figure 22:
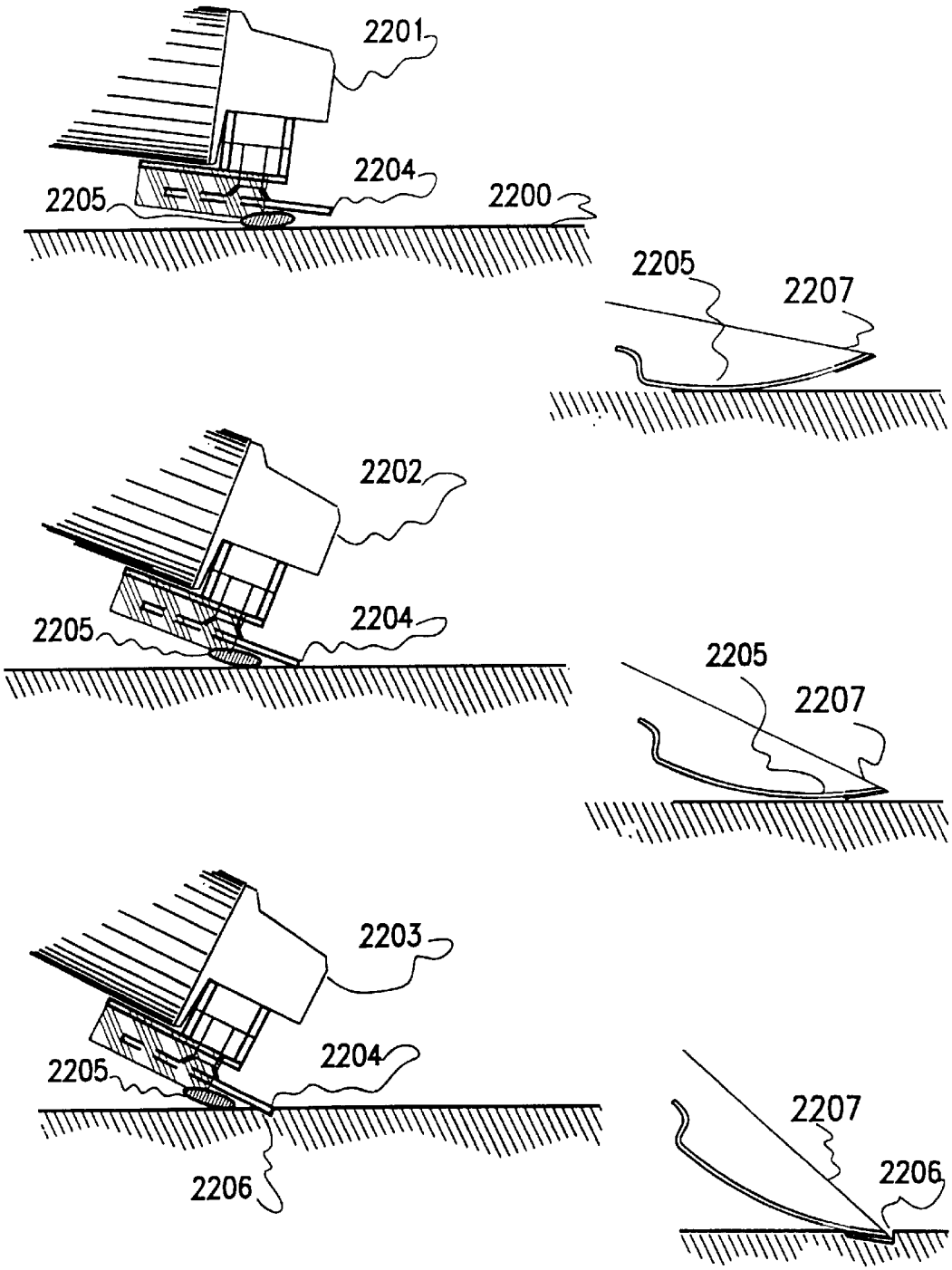

FIG. 22: shows the method whereby the grinder is inclined about the rest point in order to engage, or further engage, the active contact zone with some work material.

Figure 23:
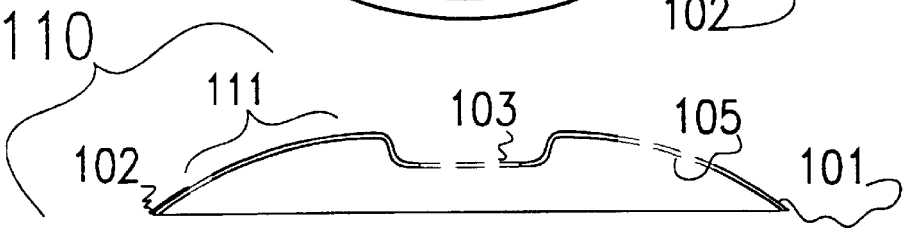

FIG. 23: shows the disk of FIG. 1 in profile, along the lines A—A.

PREFERRED EMBODIMENT

THEORY AND PRINCIPLES

The invention provides a hand-held grinder system; as practically all of these are for the type of machine known as an angle grinder we shall predominantly refer to angle grinders.

We have provided the grinding tool with a rest means to lean or rest the tool on the work surface, while in use, and from that leaning or rest point, gradually slope or incline the machine until the cutting face or edge of its disk starts cutting or abrading the work surface. From this time the machine may be slid or "stroked" preferably towards the operator; meanwhile the surface to be treated becomes visible through holes in the spinning disk prior to cutting. We call the invention a "system" because we can provide the rest point on the body of the angle grinder; most conveniently as part of a guard beneath a portion of the wheel (FIG. 21) or because we can provide the rest point on the spinning disk, where it may form:

(a) A more central part of the disk—here a domed or convex disk is preferred (FIG. 2/101), (b) An attached protrusion such as a domed washer, spinning with the disk (FIG. 10/1064)(here the disk itself may be flat though still providing cutting teeth at one side of its perimeter) or (c) An attached though separately rotatable protrusion, such as a domed washer mounted by means of a bearing onto the disk or grinder spindle. This is commonly termed a "dead" guide.

Intimately associated with this method-based concept is the provision of a range of novel toothed cutting wheels (such as FIG. 1), (having cutting zones suitably placed for use with the above rest zone) for an angle grinder having cutters which, as compared to the prior-art sanding disks or abrasive cutoff wheels, can make a substantial and speedy yet well-controlled impact on a job while the swarf is ejected as large shavings rather than fine dust. The wheels (or disks or tools) generally have an active zone or permitted area comprising the entire outer perimeter extending inwards by about one third of the radius, or an active zone comprising isolated abrasive or cutting sites within the entire permitted area.

In more detail, the preferred blade comprises an optionally perforated metal disk capable of attachment to the angle grinder shaft. Preferred disks are convex, like the saucer for a cup, and have cutting teeth on or about the convex perimeter. A relatively small number (typically 3–5) of cutting edges each in close dimensional relationship to a rubbing surface or gauge plate located at about the same radius, have a limited effective tooth protrusion of usually under 1 mm, though up to 2 mm is feasible for a disk of about 125 mm diameter. In general, angle grinder disks range from 100 mm to 200 mm diameter, depending on the capacity of the motor to power a disk and the size of the guard. The cutting edges are close to the rim and on the convex outer surface of the disk, though they may extend to and around the rim onto the concave side in some versions. Preferred cutting edges are made from tungsten carbide inserts which are brazed into place optionally adjacent to throats and then ground to final shape.

The cutting blade may be thought of as resembling a carpenter's hand plane in its mode of action, although its shape and the disposition of the blade (preferably, blades) have been altered to become suitable for use as an angle grinder tool. We compare the tool to a plane, rather than a saw or a chisel or an abrasive material because (a) the cutting mode is a shearing or scraping action, (b) by artificially formed hard teeth, (c) the teeth are mounted in relation to a rubbing surface so that the maximum depth of cut is preset. An abrasive has naturally formed teeth—made from the material of the abrasive, and a smooth finish can only be obtained by using such small particles that the scratch made by each one is infinitesimal in relation to the overall work-surface roughness. The rubbing or reference surface used to limit the depth of cut made by a chisel is a part of the blade. The invention resembles a chisel in one way, because the depth of cut can be varied by tilting the tool against the work, but the maximum depth of cut is preset to perhaps 20–40 thousandths of an inch per tooth. The blade differs in purpose from an electric plane in that it is designed for making freehand curved shapes rather than accurately flat surfaces.

Because the invention is a disk rotated at a high speed it acquires a considerable angular momentum which helps provide a steady rate of cut. In one preferred form, the cutter is adapted to be used with a conventional angle grinder of the widely used type having a typical no-load rotation speed of 11,000 rpm, driven usually by a universal (AC/DC) brush motor. Conventional angle grinders provide a drive shaft onto which various discs (normally of abrasive material) may be mounted and spun at a high speed. A typical angle grinder is the single-speed 115 mm grinder sold as the "AEG WSL115" (TM) (600 watts). This size of motor provides an acceptable power for the prototype disks. A variable-speed angle grinder may be an advantage.

In use, the work-material and the disk are brought together so that the work-material approaches the cutting zone from the centre of the disk—and the trailing edge of the cutting area is the disk edge. The work at or close to the site of cutting is partially visible through holes cut through the disk.

When using an angle grinder with a cutter according to this invention, the preferred movement is to drag the tool towards the user, or stroke it over the work material, while the cutting edges are cutting into the material. The preferred apertures allow the user to see, through the cutter, the site where the tool is about to cut. There is relatively little or no "kick" from the tool (not often the case with ordinary angle grinder tools or saw-like modifications,), and it is easy to hold and control the machine during operation in order to carry out relatively fine movements.

The angle made by the handle of the angle grinder to the work is typically about 30 degrees, (varied by the user from about 15 degrees to about 40 degrees) using the example cutter, but this depends on the shape to be formed. The angle allows the effective tooth protrusion amount to be varied. FIG. 22 illustrates this method, in which the rest means is a nose (left side series) or a rubbing surface. At the left are three variations (2201, 2202, and 2203) of tilt (respective to a work surface 2200) of an angle grinder with a nose 2205 and a flat disk cutter 2204; wherein the grinder system is being tilted on its nose 2205 so that the rotating disk 2204 approaches the work. In the centre left drawing the disk is just contacting the work. In the lowest left drawing it has eaten into the work at 2206 and swarf (not shown) is being ejected. At the right of FIG. 22 is shown three angles of tilt of a convex cutter blade 2207, where the rubbing surface 2205 (which in this example is a part of the actual blade) moves towards the periphery until in the lowest drawing the blade is cutting into the work surface at 2206. Under full working load the cutter has a rotation speed of 8,000 rpm, which approximates, for a 3-tooth blade, 400 cuttings per second, or 24,000 cuttings per minute. The operator uses the sound of the loaded motor as a guide in adjusting the speed of cutting.

HOW IT IS USED

The tool is generally used to remove material from a surface, under hand control, where the holes through the disk allow the operator to see the work, and the lack of dust maintains visibility. It can be used as a trenching tool, to cut a gutter or trench, but it is not intended to be used as a saw. The cutting edges of the dished cutters in particular are not symmetrical about each side of the edge of the cutting disk.

In use the teeth on the cutter produce a chisel- or plane-like cutting action as opposed to the microscopic scratching action of an abrasive wheel. The material is consequently removed in pieces; sometimes as shavings like those removed by a plane, or as whiskers, depending on the type of material and the way that the tool is used. (Abrasion may at times also resemble chisel-like cutting while the abrasive material has suitable profiles, but these profiles are relatively uncontrolled in contrast to those of the present cutter).

The volume of material that can be removed per second with the machine depends on a number of factors including its softness, tool speed, applied pressure, edge sharpness, and the like. Observations of cutting speeds five times that of a router or planer, and twenty times that of an abrasive disk have been made (given equal tool power ratings). The cutter can be used to hand-mill solid masses of aluminium, and has been demonstrated to cut quickly and reliably on a 50 mm rod of plain aluminium, a material prone to "drag" when turned or milled, and clog up conventional tools and abrasives.

TOOL DETAILS

The cutter of FIG. 1 shall be described in the most detail, and other examples shall be referred to when relevant. A cutter 100 is intended for rotation in the direction indicated by the arrow 109. The cup comprises a disk 101 of 108 mm diameter formed in preferably 3 mm mild steel plate. As shown in FIG. 23, the projected section 110 along the line A—A, the disk 101 has a convex, dished or saucer-like profile. (A range of alternative profiles is shown at 200 in FIG. 2). There is a number of perforations 105, a central mounting aperture 103, and a number of tungsten carbide inserts 102 with cutting teeth brazed into recesses around the perimeter, alongside (optional) throats (FIG. 3: 305). The intended direction of rotation is anticlockwise as shown by the arrow 109. The inserts present cutting edges parallel to and slightly projecting from the plane of the convex face, as at 106, and also (in this example) cutting teeth at the periphery 107.

TEETH

The three teeth 102 are made from tungsten carbide inserts, preferably brazed (or otherwise affixed) about the perimeter of the cutter on the border of a cutout or open perforation extending inward from the perimeter. We have found that blades with three teeth operate more smoothly than four-tooth blades. There is surprisingly little reaction or "kick-back" which makes these blades much safer to use and much easier to use and control. As one increases the tooth number much beyond the next odd number, 5, the power required from the angle grinder increases so much that a suitably powerful motor tends to become heavy to hold and hard to move freely. A commonplace 600 W type of angle grinder slows down too much—it works too hard. There are, of course, six-inch angle grinders. However, a fixed-position rotatable blade according to this invention that is used in a shaping machine of some kind may not have that limitation of weight and hence power.

An example tooth will now be described in detail with reference to FIGS. 3, 4 and 8. There are many possible shapes! While our first prototype was made by selecting an insert of tungsten carbide from stock that was ground into shape before attachment, we prefer to have inserts made (sintered) to order, because this minimises finishing operations. In the event of a cutter having a thickness of much less than 3 mm, the blade thickness may need to be increased by rolling or the like, to provide a more substantial bed for attaching the carbide insert. In commercial use an insert would be formed at sintering time so that it is already substantially in a desirable shape. FIG. 4 shows steps 401 . . . 404 in manufacture. FIG. 4 shows the steps of taking a tungsten carbide insert 401, a cutter disk 402 having at least one preferably angled receptacle, and brazing (at 403) the insert into a recess 408 cut across the edge of the cutter blade 402 at a shallow angle of preferably about fifteen degrees. A sharpening operation results in a sharpened insert held in the cutter blade at a slight angle, as at 407. This angled recess gives the insert a substantial seat while ample cutting material is retained at the working face. Preferably the brazing material 405 used includes a high silver content (particularly for disks of materials that are more difficult to braze) and a preferred type of prepared paste is the "Easy-flow" type. In commercial practice, inserts may be secured using current from a spot welder to heat the insert so that a paste of brazing metal and flux lying below the insert is caused to melt and run, thereby neatly brazing the insert in place.

FIG. 16 shows a tungsten carbide insert 1600 including an improved surface for bonding to the cutter disk. This insert has a series of raised, pyramidal or tetrahedral protrusions 1602 over its underneath surface 1601. They may be pressed into the insert at the time of manufacture (a sintering operation). Corresponding indentations may be pressed into the depression made in the disk, at the time of pressing the entire disk or afterwards if several steps are involved. The advantage of this sculpting is that there is more area for brazing to cover, and that there is progressive cracking and failure of the insert, rather than total loss at the first insult. Alternatively, a series of grooves may be ground into a stock insert before brazing and these will serve a similar purpose in relation to progressive failure. Inserts are available ranging from hard-wearing versions to high shock resistance versions, and optimised blades can be made for different versions incorporating selected types of insert. Some versions allow a person attacking old fibreglass within a boat under repair to work without regard for embedded nails and the like.

In FIG. 3 (a portion 300 of a finished cutter), the side view shows how much of the carbide insert 303 is visible on the working surface, while 308 shows how little of the actual insert can be seen from the non-working surface 307. (304 is surplus brazing material). In most cases all the teeth of a cutter are mounted on the same side of the cutter. In this version, we have provided cutting surfaces (the pointed tooth tip 308) at the edge so that the user can cut a groove in material. These points can be ground off if the user happens to be a panel beater—otherwise they may cut through motor car body metal.

As shown in FIG. 8, each tooth 800 is ground using a hard wheel, such as a diamond-impregnated wheel and preferably in situ to provide a cutting face having a positive cutting edge 807 between the facet 804 and the left hand edge (section 802, from across line B—B) with an included angle usually less than 90 degrees, and optionally an extra rubbing face 803 (section 801, across line A—A) as well, having an included angle with the left hand edge of the tooth preferably greater than 90 degrees. The facets 805 and 806 are where carbide has been removed so that it will not protrude. The cutting edges 807 are preferably placed on the face of the disc rather than on its edge, and are preferably relatively wide (here 6–20 mm (or 10–18 mm for another configuration) for a 115 mm (4½") disk) so that material may be removed quickly and so that a smooth finish may be left after cutting more slowly. The rubbing face, which can be further towards the periphery of the disk, helps to prevent the cutters from digging into the material by more than (about) a few tens or hundreds of microns below the surface) and may thus be analogous to the sole of a woodworker's plane.

While it is convenient for some applications to provide a rubbing face 802 at the back of each tooth 800, it is also possible to employ the remainder of the disk at about the same radius as a sole and then the teeth may have a simpler profile. It is not easy to draw this principle of design to scale as the effective protrusion of a tooth above the sole as it rotates may be at most 2 mm (for a 4.5 inch disk). The tips of these inserts or teeth also provide a cutting action at the periphery of the cutter. They may extend by from 0.25 to 1 mm. We have to advise panel beaters to grind these edge teeth down because they can cut through the metal of a vehicle as easily as they can cut through fairing compound.

It is also possible to form teeth from (a) the disk material itself, preferably locally hardened, or (b) of or including other hard materials, such as certain ceramics, diamond, perhaps as an applied film, or borazon (boron trinitride), tungsten alloys, cobalt, cobalt alloys, chromium, chromium alloys, steel, steel alloys, ceramics, carborundum, diamond-impregnated materials, and the like.

TOOTH EDGE PROFILE AND ORIENTATION

A cutting disk can be made with flat teeth for an optimised planing action. The direction of the length of the tooth edge should preferably not be along a radius. Prototypes which were, were likely to chatter. The outermost portion of the edge is leading during rotation; as a result, there is a tangential scraping action.

The angle made by a section through the tooth perpendicular to the work surface in the direction of rotation is typically less than 90 degrees, so avoiding a "biting in" effect which could pull the insert out of the blade. Details are given later.

In some cases we provide the portion of the cutting tooth trailing the actual edge with a raised profile acting as a gauge so that there is a further limit to tooth protrusion, as shown in exaggerated profile in FIG. 8. In other cases, we can provide a dedicated insert for the purpose, as at 1010 in FIG. 10.

BROACHING TEETH

FIG. 14 shows a portion of a cutter blade 1400 having (at least in part) a broaching action. In this type, one tooth uses the other as a kind of "sole" as for a conventional broaching tool. Possibly during cutting the first tooth raises the material to be cut away and the following higher tooth cuts it. This effect appears to occur in shaping fibreglass. It has been found that this type of blade is particularly suited to cutting hard material like magnesium-aluminium alloy, silicon-aluminium alloy, brass, bronze, mild steel, for which it is suitable (for instance) for bevelling the edges of sheets, and possibly even being able to cut weld seams of stainless steel. It has the advantage that the swarf is not hot—sparks are not emitted—and one can touch the work surface after cutting. Furthermore, the swarf is kept behind the blade and away from the operator. An example tooth 1404 is shown in section (along the line A—A) at 1401. The tooth edge 1403 extends above the cutter surface by the height of the scale—about 20 thousandths of an inch, and the other tooth 1402 extends by a further 20 thousandths of an inch. Another disk was made with the first tooth height $^{12}/_{1000}$ inch, the second tooth height $^{32}/_{1000}$ inch and the tips projecting by 10 to $^{28}/_{1000}$ inch. The tooth edge is inclined at about 45 degrees to the radius. The grade of tungsten carbide insert is 883 (P25). The base of each insert may include a series of sculpted extensions as shown at 1602.

MASONRY-ADAPTED TEETH

FIG. 12 illustrates a cutter blade 1200 adapted for work with brittle, hard material such as concrete or masonry. In this example three sets of small embedded teeth 1202 are embedded in the convex surface of a blade 1201. Each tooth 1203 or 1205 is a trapezoidal inset of a relatively hard tungsten carbide. They may be placed in linear arrays as shown at 1203, or in groups as shown at 1202. At the left, a portion of the wheel 1200 is shown enlarged, with an array of teeth 1203 on a single carbide insert 1204, secured in the usual manner to the blade. An insert 1204 is depicted in the shape in which it would be attached to the blade 1201. This shape may be created by grinding, by moulding, or by a combination of both. One advantage of this version of the invention is that the teeth are securely embedded. 1206 indicates the arrow for the preferred direction of rotation. This type of blade is expected to produce dust, and any holes that may be provided in the disk are primarily for viewing purposes, and for .pa blowing dust away. Advantages of this type of cutter include that it can freely shape masonry or the like, and other materials such as embedded reinforcing iron are also dealt with without requiring that the tool be changed and without inevitable damage to the tool.

CUTTER DISK ITSELF

We prefer to provide a dished cutter so that we can place cutting teeth on the outside or convex side of the disk near its rim, and so allow the user to vary the depth of cut by tilting the disk. Disks can be curved in profile, or include a conic section, or in some cases may be flat. At the disk centre we prefer to provide a profile that mates with an arbor (see FIG. 15), though optionally each cutter may include a thread for direct mounting, perhaps with a spacing washer. The conic or curved profile can be a separate part of a disk assembly (see FIG. 10).

We have made our prototype cutters from mild steel sheet, from 3 to 6 mm in thickness, and from stainless steel, though other materials can be used. The overall diameter is set by the cutter guard and generally ranges from about 4 to 4.5 inches (100–112 mm) for a nominally 4.5 inch angle grinder. The first prototype was made by spinning a heated disk of mild steel on a lathe. Other methods of forming a metal cutter include stamping and shaping from sheet stock, or using laser-cutting techniques (particular for hole cutting), then pressing in a die. A cutter of a plastics material may be made by the usual techniques such as injection moulding and optionally these techniques include a fibrous base or core about which a matrix is added. In the event of a cutter having a thickness of much less than 3 mm, the blade thickness may need to be enhanced, by rolling or the like, to provide a more substantial bed for attaching the carbide insert. Flat-bladed cutters can be produced according to this invention. A small number of teeth around the edge are inset generally as for a circular saw blade, as shown in FIG. 10 (which is primarily to illustrate various ways of mounting teeth). In order to provide a rest zone or rubbing surface, a kind of dome nut is used as part of the attachment of the disk to the grinder drive shaft. The head of this dome nut is held in rubbing or sliding contact with the work, and the cutter is tilted so that the teeth dig in at a suitable rate.

The dome nut may be shaped more like a mushroom, but then the increased radial velocity of the surface in contact leads to increased friction, wear, and reaction forces. A typical dome nut-equivalent mount for a flat blade is shown in section as 1060 in FIG. 10, where the arbor of the angle grinder is 1061, a securing nut is 1062, the central portion of a flat blade is 1063, and the domed spacer is a curved conical device 1064, concentric with the securing bolt 1062.

Optionally, the domed spacer or at least an outer portion of it may be rotationally mounted—for example, on a ball-bearing—so that it may come to rest rather than rub on the surface of the work, and provide a rest zone as a non-rubbing surface without friction. In the case of some plastics (for example), the friction generated by sliding at the rubbing surface (especially at the rates of revolution typical of angle grinders) may cause local burning, melting, difficulty of control, and damage to the surface. This improvement overcomes that problem. We have not illustrated a ball bearing in FIG. 10, but it would be placed about the stud or bolt member 1062.

A further type of rest means is provided on the actual angle grinder itself—not on its cutter. FIG. 21 illustrates a hard "nose" 2101 of for example hardened steel, chromium alloy, or for some applications a low-friction nose of PTFE plastic (polytetrafluorethane or "Teflon (R)") which is attached to the centre of a partial guard 2102 attached beneath the cutter of an angle grinder 2103. The beneath view B depicts an aperture 2104 which is intended for the ejection of waste material—swarf and the like. The side view A shows a flat disk type of cutter 2105 which is provided with cutting teeth (or like means) presented to the edge 2106. It will be evident that if the nose 2101 is rested on work material, and the body of the angle grinder 2107 is tilted so that the "active" edge 2106 of the cutter comes into contact with the work, an operator has a far better degree of control over rate and depth of cutting than if he or she has no "nose" or rest means and has to set the active edge in the correct position solely by hand positioning.

The guard 2102 may be provided with a hinge and catch mechanism (not shown) so that it can flip open to allow the cutter to be cleaned or changed. Part C of this drawing shows a cutter blade 2108 having a dished profile and the adjacent nose 2101 and guard 2102. This presents a more nearly parallel alignment of tooth edges to a sheet of work material and is for example more suited to hand planing. This modification to provide a grinder system having rest means is not incompatible with the extra guard 1705 offered in FIG. 17 for the upper surface of the cutter disk.

CUTTER HOLES

Perforations in the cutter disk are provided in part so that the user can see the material to be cut through the spinning blade as he/she is drawing the cutting area towards himself/herself. For convenience the perforations are circular or at least have no sharp or narrow corners because of the risk of propagation of cracks from stressed areas. 24 mm diameter holes have been used. The holes are equidistant from the centre in FIGS. 1 and 9. Clearly, hole positions should be selected so as to retain the balance of the cutter, and cutters may be balanced dynamically by removing material from hole edges. Cutter holes need not be related to teeth on a 1:1 basis. Any convenient number of teeth may be combined with any convenient number of holes. Similarly, the number of gauge plates or other projections used (should the rubbing surface be inadequate) to limit the bite taken by each tooth need not be on a 1:1 ratio to the number of teeth.

The perforations may also aid in stirring the air so that any swarf is carried by the moving air and is ejected further or more effectively. For moving air the holes may be racked (drilled obliquely) or pitched. They may also be used as clamping points for a jig for alignment of the cutter in automated sharpening operations.

Holes are a preferred option for this cutter; providing visibility of the work about to be cut, and aiding (especially if raked) in stirring and moving the air. The preferred embodiment has three equally spaced holes. Other combinations which place various holes at different distances from the centre may be used; although it is always preferable to maintain static and dynamic balance in rapidly rotating cutters such as this one. FIG. 5 illustrates a cutter 500 with opposite pairs 502 and 503 of holes at two different spacings which have the effect of broadening the operator's view of the job during use. One of the holes 503 is drawn as substantially square (with radiused edges), as the invention is not limited to the use of round holes.

The trailing edges (in terms of the preferred direction of rotation) of one or more perforations may be shaped so that they can act as cutting edges, by depressing them in the direction of the anticipated work material (that is, away from the body of the angle grinder) and preferably providing a hardening treatment.

The leading edges of one or more perforations may be shaped as in FIG. 10 at 1003 so that they can act as gauges for nearby cutting edges 1004, by depressing them in the direction of the anticipated work material (that is, away from the body of the angle grinder) and preferably providing a hardening treatment. The perforations may advantageously be rectangular or even slot-shaped for cutting purposes, if this renders them easier to form and to sharpen or re-sharpen.

CUTTER THROATS

Throats may be provided adjacent to teeth. An open throat aids in producing large, thin shavings which tend to be blown free. A small throat tends to break up shavings into dust, and is to be preferred for aluminium and brittle plastics. Cutters made according to the principles above generally produce swarf in a practically dust-free shower of shavings emitted somewhat upwards from the grinder. In contrast, a grinding wheel produces its sparks, or dust, at a tangent to the wheel. We have found that it is possible to modify the pattern of swarf thrown out from the wheel. If we use a narrow throat, or even no throat at all, swarf flies out tangentially, though with a significant amount of dust which, as described previously, comprises a hazard. Possibly the removed material is broken up by repeated collisions with the walls of a narrow throat, and with other material and with the yet uncut material being shaped. We have found that the use of a chip guard, comprising a flap of material projecting over the throat, has the effect of causing swarf to be thrown out substantially tangentially while causing only a minimal amount of dust to be produced. (The material on which this was tested was (a) wood, (b) fibreglass, and (c) panel beaters' fairing compound). A preferred arrangement of cutter having chip guards is illustrated in FIG. 13, though this method of construction, having a spot-welded bases 1303 is more suited to prototyping than bulk manufacture of cutters in quantity, where wings resembling the spot-welded wings of FIG. 13 may for example be stamped and formed from the cutter plate so that the throat, in section, has a smooth internal curve. In FIG. 13, the prototype disk 1300 as seen from the concave side includes a wing 1302 over the throat 1301. The wing tends to keep the swarf inside the throat until it has collided with itself and been converted into a finer grade of material.

It is possible to delete the throats, as shown in FIG. 14 which is of part of a cutter blade generally according to the invention but including broaching cutters. FIG. 14 has been described previously.

SWARF CONTROL

Aspects of swarf control have been mentioned above. In the event of undue amounts of swarf being projected towards the operator, we provide a transparent, tough guard for use on the grinder as shown in FIG. 17, where the grinder 1700, with a handle 1701 and a body 1702 has a cutter disk 1704, and mounted on its shield 1703 there is a guard 1705. Preferably the guard is cheap and effectively disposable, and preferably it can be attached to the angle grinder in a firm yet reversible way; probably to the existing guard about the portion of the disk near to the operator's hands. Suitable attachment means may include spring clips, bayonet-lock clips, screws, bolts, and the like at the position 1706. A preferred guard material is polycarbonate resin. This guard may deteriorate with use, as it is likely to become scratched, and may be replaced from time to time.

MOUNTING MEANS

We have provided a central threaded aperture in our prototypes. Generally a spacer or thrust washer of approximately 10 mm thickness is used about the arbor or spindle of the angle grinder, beneath the concave face of the cutter, so that its spinning cutters clear the guard of the angle grinder; although a suitably pressed cutter having a depressed mounting hole may not require the use of a spacer. Conveniently the threaded cutter prototypes do not bind onto the angle grinder during use.

An alternative arbor arrangement is described, with reference to FIG. 15. Here, 1502 is a section through a disk, made with a central depression 1505 to substantially match the profile of the (sectioned) arbor 1503. 1501 is a clamp nut. It is tightened against the central part of the arbor at 1506, giving a separation about the depression 1505 of the disk which would allow the disk to spin freely. Gripping means are provided to hold the disk by static friction until a high torque overcomes the friction, whereupon the disk is temporarily released. This clutch action may on occasion save the gearbox or other parts of the angle grinder from inadvertent damage. In principle the gripping means may comprise an "O" ring within a slot in the nut 1501, as shown at 1504, but a more durable form of resilient grip such as a kind of crinkle washer, as shown at 1507, may be preferable. An advantage is that only one range of types of cutter blades need be manufactured for all types of machine, since the arbor acts as a compatibility adapter. (This drawing does not include the aperture for the angle grinder drive shaft).

A further improvement is the use of a flexible or resilient mount, inserted between the arbor of the angle grinder and the material of the disk—any disk described or illustrated herein. FIG. 19 shows at 1900 a resilient central mount for a wheel 1901, having among other purposes the objective of minimising the effect of wheel imbalance on tool vibration. In FIG. 19, the resilient material (which is illustrated as 1906) is contained within a housing 1904 attached to the wheel, while a central threaded collar 1907 surrounding an aperture 1902 is attached to a fin 1905 running deeply into the resilient material, which is generally a type of rubber. There is a small gap at the base to allow wobble between the housing and the thread at 1903. Optionally the small gap may be at the outside, and the inner gap may be an interference fit. Optionally there may be a further layer of metal, between (and attached to) the resilient material and the fin 1905, to which it is not attached apart from a frictional grip, thereby providing a clutch so that if the torque exceeds a threshold, the fin 1905 may slip inside the further layer of metal. The base of the threaded collar (by 1907) serves as a nut to lock the wheel onto the arbor of the grinder.

FIG. 16 shows an improved method for mounting cutter inserts on or at least partially within a blade. Tungsten carbide inserts may be brazed onto steel. However the sideways forces applied to inserts used on the cutters of this invention may be more likely to break down the brazed attachments than if a direct compression is applied. Accordingly we propose to sculpt the rear faces of the inserts, and optionally also sculpt the indentations or attachment sites on the cutter blade. This provides a greater attachment area, and provides for forces to become more normal to at least portions of the brazed junction.

FIG. 18 illustrates a further modification to the range of disks for an angle grinder. In this example the usual cup-shaped wheel 1800 having a central mount 1801 and viewing or dust-removal holes 1802 (optionally the holes may be provided with cutting edges) is provided with an abrasive rim 1804. Typically this may be 1–2 mm tungsten grit, or cobalt high-speed steel grit, embedded in a matrix capable of holding the grit on the wheel periphery during use. Optionally a flat wheel having a similar abrasive edge may be provided with holes, and is mounted on the arbor of an angle grinder with a large dome nut. This modification provides a type of sanding wheel, but unlike previously available cutoff disks and the like for angle grinders, the force with which the cutting or abrading edge is applied to the work may be varied by (a) providing a non-cutting portion of the wheel (at about 1803) for rubbing against the work and then (b) varying the angle of the entire tool so that the cutting portion is controllably brought against the work. A steeper angle results in a deeper cut.

FIG. 20 illustrates an abrasive wheel adapted for masonry or the like. This is preferably a saucer-shaped wheel as shown in FIG. 1:102. This wheel is provided with sectors 2001, 2002 of material having an abrasive effect and there may be from 3 to 12 such sectors on a typical wheel. Again, perforations may be provided in order to shift air and hence remove dust, and to allow the operator to see the material that is about to be attacked. Each sector of abrasive material is comprised of one or more attached pieces of durable material such as tungsten carbide. When magnified, the outer surface of the material 2004 has a profile as shown at 2003 where there are ridges, or more preferably isolated peaks separated by valleys. The peaks may resemble tetrahedrons. From the surface the material may appear as if it has been knurled. This type of surface can be formed at the time of sintering the sectors of tungsten carbide, or can be ground in after the carbide has been attached to the cutter. Generally the carbide is attached in the outer third of the wheel—in the so-called "active area" or "permitted area".

FURTHER VARIATIONS

The cutter may be fabricated from sheet material by pressing, spinning, or using some other material by an appropriate fabrication means. A cone-shaped cutter 205 or a flat cutter 206 could be used as an alternative to the cup-shaped cutter used as an example. The cutter may be used with other machines, although its construction is particularly adapted for use with a hand-held angle grinder. One would generally use a known shell cutter with a standard milling machine, or a blade in a skillsaw or a saw bench.

While three teeth have been used in the preferred embodiment, other numbers may be used (preferably within the range of from 1 to 24) and preferably an odd number of teeth. Alternatively a cutter may be provided with serrated teeth (like the flutes of some end mill cutters) for more rapid cutting in the initial stage of a job, although these may produce rather more fine swarf and dust. The one-tooth cutter may be preferable for planing applications with a low-power or "home" angle grinder, some of which have ratings of 350 W or less.

While a preferred cutting edge is made of individual inserts of tungsten carbide, other options such as a ceramic, or diamond material may be used. Some versions of cutter could be created simply by a pressing operation during manufacture after selecting as a cutter a material having, or being capable of acquiring, an edge of suitable hardness. These options include: hardened steel (as by heating (including induction hardening) or by chemical treatment), steel comprising alloys preferably including at least one of tungsten, chromium, cobalt, molybdenum, or the like, or alternatively diamond, boron trinitride, ceramics or composites including ceramics, aluminium or alloys including aluminium, or even plastics, compressed or woven fibre, including impregnations in bulk or about the periphery of a hard compound, or at the cutting edge or edges.

Another preferred type of tooth is a replaceable tooth, an insert which is not rigidly mounted in place but which can slide towards the periphery along a restraining track, shown in FIG. 9 at 901, with edge guides at 902. This type of tooth may be provided with differentially wearing portions so that an effective edge can be maintained. Several versions of carbide insert are shown in cross-section at 903, 904 and 905, together with guide profiles 906, 907, and 908. Of these, 908 is preferred as it may be ground into an outer surface. Preferably a tension spring is included behind each tooth so that as the centripetal force is lowered when the cutter slows down during heavy use, the teeth will be withdrawn so providing the cutter with a kind of regulation. 909 is one example of a restraint to assist in confining the tooth in its slot.

Preferably the central mounting hole of 16 mm diameter (for the angle grinder mentioned above; other makes or models of grinder have different diameters) is placed within a depression 203 on the convex or outer side so that the fixing nut which holds the cutter on the drive shaft arbor or spindle of the angle grinder is recessed when tightened. Optionally the cutter may be provided with a threaded hole, so that it can be mounted directly on the angle grinder arbor without a retaining nut, or so that additional security is provided by a locking action between a retaining nut and the cutter.

It is possible to provide cutters without internal perforations as at 600, which cutter 601 also has four teeth 602, and it is possible to provide cutters such as that of 700 which have guiding means attached. The four shapes 702 represent slightly raised portions of the surface of the cutter 700 which have the effect of controlling the maximum bite available per shave, per tooth. Preferably the cutting edges do not extend more than 2 mm from the surface of the guiding means. Preferably these raised portions have a gradual rise in the direction of rotation so that they do not have a cutting effect.

A number of options for cutters are shown at 1000 in FIG. 10, for which the direction of movement is from right to left—in relation to some material to be cut. 1001 represents a section through the sheet material of the cutter, for simplicity shown here as a flat plane. 1002 is a hole, optionally a raked or obliquely drilled hole or otherwise-formed aperture. 1003 is a leading edge which serves as a guide, and 1004 is a cutting edge. Here the plate of the cutter itself is assumed to have been hardened so as to provide a relatively durable cutting edge. Another option includes inserts of harder material at 1010 (the guide or baseline (like the sole of a plane)) and 1011 is the cutting tooth). In a further option, 1020 represents a fixed tooth typical of the cutter of FIG. 1. This tooth has a negative rake, while tooth 1030 has a positive rake. 1040 is a further variant, and 1050 is a positive rake tooth with a guide plate 1051.

These "active" perforations may comprise the sole cutting elements or "teeth" of a cutter, and they may be open-ended perforations located towards the periphery of the cutter as shown in FIG. 1 (but lacking the hardened inserts) or they may be closed perforations elsewhere on the disk.

FIG. 11 illustrates several methods for mounting a hardened insert on a cutter blade. 1100 is a section through a portion of a cutter blade. 1101 is a tungsten-carbide insert brazed onto a bent face of the blade. 1102 is another insert brazed into a seat made by punching or pressing a cavity into a blade. 1103 is a much smaller insert brazed onto a sharply bent lip. These methods are more commercially viable than our original obliquely milled seat.

Apart from the cup-shaped, 108 mm diameter cutter described above, a larger diameter cutting wheel has been constructed for use with a larger angle grinder, and a flat plate cutter having guide plates in order to limit the depth of cut has been made.

ADVANTAGES

Advantages of preferred forms of this invention include:

1. Material is usually removed in the form of individual large shavings or scrapings rather than as a dust;

2. The tool operates upon a wide variety of materials, ranging from steel and aluminium to even wet timber and partially cured automotive body filler. (Optimised tungsten carbide inserts may vary for a wide range of materials). Material such as partially cured or cured automotive type body-filler material or solid aluminium can be sculpted, while soft materials such as lead or linoleum which would rapidly clog an abrasive are also quickly cut;

3. Material is removed quickly—removal speed is about 5 times quicker than for a router or planer, and about 20 times quicker than for a sanding disk—other factors being equal.

4. There is little reaction or kickback against the cutter edge, reducing stresses on operators, and minimising the risk of exhaustion and errors which may be expensive and/or dangerous;

5. Control of the results is excellent, achieved by tilting (to vary the bite) and moving the tool over the work surface, while experiencing little kickback.

6. The user can see through perforations in the spinning cutter to accurately produce a desired conformation, or shape;

7. Unlike abrasive wheels conventionally used with angle grinders the cutting edges are of controlled form and dimensions and the tool does not substantially change shape during use, unlike many abrasive wheels;

8. The tool can be resharpened with a diamond grinding wheel once the teeth have become dulled (although slightly dulled teeth give a better finish on many materials);

9. The material of the disk need not be high-quality steel as is the case for circular saw blades, for example.

Finally, it will be appreciated that various alterations and modifications may be made to the shape of the cutter, the teeth, the materials used in constructions, without departing from the scope of this invention as set forth.

I claim:

1. An accessory for a grinder including: a rotatable tool having a shape substantially that of a disk, having an axis of rotation and a central mounting aperture for mounting the disk on an arbor of an angle grinder, characterized in that the rotatable tool is provided with at least one working zone at or near the perimeter of the tool; and a rest means extending substantially radially inwardly from the at least one working zone of the tool, which rest means is displaced from the working zone along the line of the axis of rotation.

2. An accessory for a grinder as claimed in claim 1, characterized in that the rest means is a domed annular structure concentric with and in contact with the rotatable tool.

3. An accessory for a grinder as claimed in claim 1, characterized in that the rotatable tool has a convex surface and the rest means comprises a portion of the convex surface which provides at least one rubbing surface located between the working zone and the axis of rotation.

4. An accessory for a grinder as claimed in claim 1, characterized in that the rest means comprises a fixed rubbing surface supported on the angle grinder and displaced so as to be supported beyond the rotatable tool.

5. An accessory for a grinder as claimed in claim 1, characterized in that the at least one working zone comprises at least one area within a permitted surface of the rotatable tool, said permitted surface extending radially inwardly over the working surface of the tool from the perimeter over substantially a first third of the radius of the tool.

6. An accessory for a grinder as claimed in claim 5, characterized in that the working zone of the rotatable tool is provided with at least one cutting tooth each tooth having at least one cutting edge lying in a plane substantially parallel to the surface of the tool adjacent the tooth and projecting above the adjacent surface of the tool by a height of up to 3 per cent of the tool diameter, so that the depth of cut of each tooth is limited.

7. An accessory for a grinder as claimed in claim 5 characterized in that the working zone of the rotatable tool is provided with at least one sector comprising a hardened surface bearing a series of stubby projections and a rubbing surface adjoining each sector and extending in the plane of the surface of the rotatable tool.

8. An accessory for a grinder as claimed in claim 6, characterized in that the cutting zone is an abrasive surface comprising a matrix including a hard granular material coated onto at least a portion of one side and/or the edge of the rotatable cutting tool.

9. An accessory for a grinder as claimed in claim 6, characterized in that each tooth is made of shaped tungsten carbide and is fixed to an attachment site upon the rotatable tool.

* * * * *